US010035163B2

(12) United States Patent
Gehrer et al.

(10) Patent No.: US 10,035,163 B2
(45) Date of Patent: Jul. 31, 2018

(54) LIQUID APPLICATION SYSTEM

(71) Applicant: Brav-O-Tech GmbH, Duisburg (DE)

(72) Inventors: Udo Gehrer, Würselen (DE); Johannes Hicker, Duisburg (DE); Roland Hicker, Bochum (DE)

(73) Assignee: Brav-O-Tech GmbH, Duisburg (DE)

( * ) Notice: Subject to any disclaimer, the term of this patent is extended or adjusted under 35 U.S.C. 154(b) by 254 days.

(21) Appl. No.: 14/782,501

(22) PCT Filed: Apr. 4, 2014

(86) PCT No.: PCT/EP2014/056792

§ 371 (c)(1),
(2) Date: Oct. 5, 2015

(87) PCT Pub. No.: WO2014/161981

PCT Pub. Date: Oct. 9, 2014

(65) Prior Publication Data

US 2016/0052008 A1 Feb. 25, 2016

(30) Foreign Application Priority Data

Apr. 4, 2013 (DE) ..... 10 2013 205 974

(51) Int. Cl.
*B05B 13/02* (2006.01)
*B05D 3/04* (2006.01)
(Continued)

(52) U.S. Cl.
CPC ..... *B05B 13/0221* (2013.01); *B05B 1/28* (2013.01); *B05B 12/20* (2018.02); *B05B 12/24* (2018.02);
(Continued)

(58) Field of Classification Search
CPC ..... B05B 1/28; B05B 12/20; B05B 12/24; B05B 12/32; B05B 12/34; B05B 13/0207;
(Continued)

(56) References Cited

U.S. PATENT DOCUMENTS 3,338,773 A * 8/1967 Schneider ..... B29C 70/08 118/301
4,517,147 A * 5/1985 Taylor ..... B27N 3/086 156/285
(Continued)

FOREIGN PATENT DOCUMENTS

DE 69812535 T2 12/2003
DE 202005009342 U1 9/2005
(Continued)

*Primary Examiner* — William P Fletcher, III
(74) *Attorney, Agent, or Firm* — Christensen, Fonder, Dardi & Herbert PLLC; Peter S. Dard

(57) ABSTRACT

It is provided in a liquid application system for applying liquid to a material cake transported on a conveyor device having a liquid application device, that the conveyor device comprises a porous section on which the material cake lies or which the material cake contacts and which is permeable for a liquid to be applied, that the liquid application device comprises an application device via which the liquid to be applied can be applied to the side of the porous section of the conveyor device facing away from the material cake, and that the liquid application device comprises an overpressure chamber having a first overpressure relative to the environment by which the porous section of the conveyor device passes, wherein the applied liquid can be transported via the first overpressure through the porous section of the conveyor device or held via the first overpressure to the porous section.

20 Claims, 2 Drawing Sheets

Figure 1:
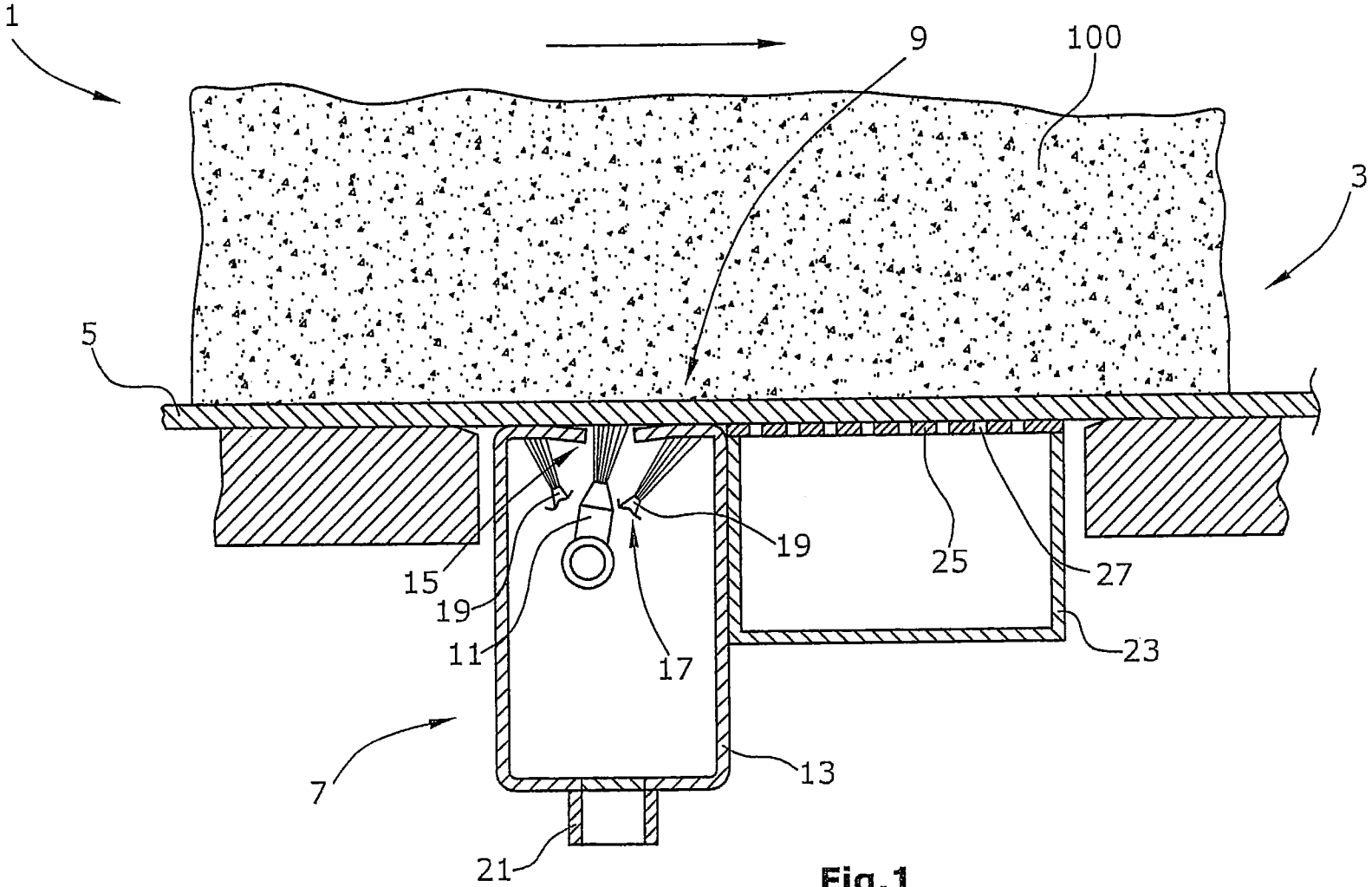

(51) Int. Cl.

| | |
|---|---|
| ***B05B 14/30*** | (2018.01) |
| ***B05D 1/32*** | (2006.01) |
| ***B05B 12/34*** | (2018.01) |
| ***B05B 1/28*** | (2006.01) |
| ***B05B 14/00*** | (2018.01) |
| ***B05B 14/20*** | (2018.01) |
| ***B05B 12/32*** | (2018.01) |
| ***B05B 12/20*** | (2018.01) |
| ***B05D 1/02*** | (2006.01) |
| ***B27N 3/18*** | (2006.01) |
| ***B05B 12/24*** | (2018.01) |

(52) U.S. Cl.
CPC ..... *B05B 12/32* (2018.02); *B05B 12/34* (2018.02); *B05B 13/0207* (2013.01); *B05B 14/00* (2018.02); *B05B 14/20* (2018.02); *B05B 14/30* (2018.02); *B05D 1/02* (2013.01); *B05D 1/32* (2013.01); *B05D 3/0406* (2013.01); *B05D 3/0453* (2013.01); *B05D 3/0466* (2013.01); *B27N 3/18* (2013.01)

(58) Field of Classification Search
CPC ..... B05B 13/0221; B05B 14/00; B05B 14/20; B05B 14/30; B05D 1/02; B05D 1/32; B05D 3/0453; B05D 3/0406; B05D 3/0466; B27N 3/18
USPC ..... 118/300, 301, 313, 314, 324, 325, 326, 118/50; 427/348, 421.1, 424, 282
See application file for complete search history.

(56) References Cited

U.S. PATENT DOCUMENTS

| | | | | |
|---|---|---|---|---|
| 6,599,456 | B1 | 7/2003 | von Haas | |
| 2005/0082709 | A1 | 4/2005 | von Haas et al. | |
| 2013/0101786 | A1* | 4/2013 | Bizic | B27N 7/00 428/106 |
| 2013/0270742 | A1 | 10/2013 | Gehrer et al. | |
| 2014/0039437 | A1* | 2/2014 | Van De Maele | A61F 13/5323 604/384 |

FOREIGN PATENT DOCUMENTS

| | | | | |
|---|---|---|---|---|
| DE | 102006058612 | A1 | 6/2008 | |
| DE | 102010049777 | A1 | 5/2012 | |
| EP | 1508414 | A2 | 2/2005 | |
| EP | 2036689 | A1 * | 3/2009 | B27K 3/0285 |
| EP | 2036689 | A1 | 3/2009 | |
| WO | 2012000901 | A1 | 1/2012 | |

* cited by examiner

LIQUID APPLICATION SYSTEM

CROSS REFERENCE TO RELATED APPLICATIONS

This application is a national stage filing of PCT Application No. PCT/EP2014/056792 filed Apr. 4, 2014, which claims priority to German Patent Application No. 10 2013 205 974.4 filed on Apr. 4, 2013, both of which are incorporated herein by reference.

The present invention relates to a liquid application system for the application of liquid onto a material cake transported on a conveyor device. Such liquid application systems find application for example as humidification systems, preferably for continuously working presses in particular for the production of panels of a material.

The invention further relates to a method for applying liquid onto a material cake.

With presses for producing material panels it is known to humidify the material cake during or immediately before pressing, so as to permeate the material with a vapor jet and to thereby introduce heat into the inside of the material cake in order to accelerate the setting of the binding agent inside the material cake.

It is known from EP 1 508 414 A2 to apply water vapor onto one side of the material cake while in the press, attempting to introduce only small amounts of vapor, if possible, so as to prevent the binding agent from being washed out and to allow as short a pressing operation as possible.

From DE 10 2006 058 612 A1 it is known to humidify the material cake with vapor prior to pressing.

Such humidification is disadvantageous in that dosing the humidifying agent is only possible in a very inaccurate manner due to the application of the humidifying agent in the vaporous state.

Further, an application of vapor is generally accompanied by a relatively great loss of humidifying agent. The application of vapor also leads to the formation of condensation on the machine parts, from where the condensed humidifying agent can then drop on the material cake. This may affect the optical appearance of the pressed panel or cause disadvantages related to process technology.

From the applicant's DE 10 2010 049 777 A1 a humidification system is known in which a humidifying agent is applied onto the material cake by means of application rollers.

However, applying the liquid humidification agent by means of an application roller entails great effort with respect to device technology, in particular when applying the agent from the lower side of the material cake.

Therefore, it is an object of the present invention to provide a liquid application system of the type mentioned above, in which a liquid can be applied onto a material cake with little effort with respect to device technology.

Further, a very accurate dosing of the liquid shall be possible and a minimum loss of liquid shall be guaranteed. It is another object of the present invention to provide a method that allows for a corresponding application of liquid.

The invention is defined by the features of claims 1 and 13.

The liquid application system of the present invention for the application of liquid onto a material cake transported on a conveyor device comprises a first liquid application device. The conveyor device comprises a porous section on which the material cake lies or which the material cake contacts and which is permeable to a liquid to be applied.

The liquid application device further comprises an application device via which the liquid to be applied can be applied, preferably sprayed, in the liquid state onto the side of the porous section of the conveyor device that faces away from the material cake. The liquid application device further comprises an overpressure chamber in which a first overpressure prevails relative to the environment, wherein the porous section of the conveyor device is guided past the overpressure chamber and the liquid applied can be transported through the porous section of the conveyor device by the first overpressure or is retained on the porous section by the first overpressure. Thus, it is provided in the liquid application system of the present invention that the liquid is first applied onto the porous section of the conveyor device and is pressed through the pores in the porous section by the overpressure and thereby reaches the material cake, or the liquid is prevented from dripping off. In this way, an application of the liquid in a liquid state is possible in an advantageous manner. In particular, it becomes possible to apply the liquid onto the lower side of the material cake, against the effect of gravity, wherein the material cake can be transported in an advantageous manner due to the conveyor device.

The first overpressure prevailing in the overpressure chamber generates an airflow that acts on or entrains the liquid and thereby transports the same through the porous section of the conveyor device. However, the overpressure can be set such that the liquid is first only retained in the porous section of the conveyor device and is transported through the same in subsequent process step.

In this regard, the first overpressure is chosen such that the gravity acting on the liquid, a capillary resistance prevailing in the pores of the porous section and a flow resistance are overcome, so that the liquid can be transported through the pores of the porous section and reaches the side of the material cake facing to the conveyor device. Further, the device-related effort of the liquid application system of the present invention is kept on a low level.

The liquid application system of the present invention allows for the application of the liquid in a particularly advantageous manner. Moreover, the liquid can be dosed in an advantageous manner by means of the application device.

As the liquid, a humidifying agent for humidifying the material cake or an oil may be provided, for example. Further, the liquid may have a temperature lower than the material cake, whereby the material cake is cooled. Thereby, it is possible, for example, to counteract a premature setting of the binding agent contained in the material cake.

Preferably it is provided that the application system is arranged in the overpressure chamber. Thus, the liquid application device can be made very compact and, in addition, it is achieved that the liquid applied onto the porous section of the conveyor device is directly exposed to the first overpressure prevailing in the overpressure chamber. It is thereby prevented that the liquid is stripped off or drops off the porous section during further transport.

The overpressure chamber may comprise an opening directed towards the porous section, which porous section of the conveyor device sealingly surrounds the opening. It is thereby achieved that the first overpressure prevailing in the overpressure chamber exclusively acts on the porous section of the conveyor device and that an airflow generated by the first overpressure cannot escape to the sides. The overpressure can thus be used almost exclusively for the transport of the liquid through the porous section.

In one embodiment of the invention it is provided that the liquid application system comprises a high-pressure chamber holding second overpressure relative to the environment, wherein the high-pressure chamber is arranged downstream of the overpressure chamber, when seen in the conveying direction of the material cake. It is achieved by means of the high-pressure chamber holding the second overpressure, which preferably is higher than the first overpressure that liquid possibly adhering to the porous section of the conveyor device is pressed through the pores of the porous section towards the material cake or is blown towards the same by the airflow generated by the second overpressure. Further, the second overpressure can be used to press the liquid present in the edge portion of the material cake deeper into the material cake. Thereby, it is achieved that a larger amount of liquid can be received in the edge portion of the material cake. Moreover, owing to the second overpressure in the high-vacuum chamber, it is possible to achieve that liquid, which is present on the side of the porous section of the conveyor device that is directed towards the material cake, is accelerated by the overpressure so that a gap possibly existing between the material cake and the porous section of the conveyor device can be overcome, whereby it is achieved that the liquid reaches all regions of the material cake surface in sufficiently large amounts and in a very uniform manner.

In this regard it may be provided that the high-pressure chamber has a cover with a plurality of openings, wherein the porous section of the conveyor device contacts the cover in a sealing manner. Due to the sealing contact of the porous section on the cover, it is prevented that an airflow generated by the overpressure can escape at the sides of the porous section. Moreover, it is achieved by providing the plurality of openings in the cover that the overpressure acts on the porous section or the material cake only at a few sites so that the second overpressure is prevented from causing the material cake to be lifted off the conveyor device or from causing the porous section of the conveyor device from being lifted off the high-pressure chamber. In this regard, it may be provided that the openings are distributed over the covers in a predetermined pattern. For example, the openings may be arranged in a zigzag pattern.

The liquid application system of the present invention may comprise a cleaning system for cleaning the conveyor device and/or the overpressure chamber. Due to the cleaning system it becomes possible that the belt is cleaned from parts of the material cake or residues of the liquid so that it is ensured that the pores of the porous section of the conveyor device are open to a sufficient degree.

The cleaning system may for example comprise cleaning nozzles for ejecting air or a cleaning fluid, in particular a cleaning liquid, by which the residual liquid or residues of the material cake can be blown or flushed out of the pores of the porous section of the conveyor device.

In a particularly preferred embodiment of the invention it is provided that the conveyor device is designed as a porous conveyor belt which forms the porous section. In other words: The entire conveyor device is porous. Of course, it is also possible that only a section of the conveyor device is porous and forms the porous section. For example, a roll that is part of the conveyor device and has a porous surface may form the porous section. In this case, the humidifying agent application device is arranged within the roll.

The porous conveyor belt may comprise a textile or mesh structure.

In a preferred embodiment of the invention it is provided that the porous section comprises a pore width between 0.02 mm and 2 mm. Preferably, the pore width is between 0.1 and 0.3 mm, particularly preferred 0.2 mm. Such a pore width has been found to be particularly advantageous. Specifically, such a pore width ensures that the liquid to be applied can be pressed through the pores by means of an overpressure in the overpressure chamber.

The invention may further advantageously provide that the porous section comprises a surface, wherein the percentage of the surface area formed by material of the conveyor device is between 50% and 95%, preferably between 60% and 80%. In other words: In the porous section, the pores make up for 5% to 50%, preferably 20% to 40% of the surface. Such a design of the porous section has proven particularly advantageous, the permeability of the porous section to the liquid to be applied being ensured thereby in an advantageous manner.

In an embodiment of the invention it is provided that a roll that presses a material cake against the conveyor device, is situated immediately opposite the liquid application device or is arranged immediately upstream of the liquid application device, when seen in the transport direction of the material cake. As an alternative, the roll may be replaced with a pressing band that presses the material cake against the conveyor device. The pressing band may also be arranged directly opposite the liquid application device or immediately upstream of the liquid application device. It is also possible that the pressing band spans over the liquid application device. By providing a roll or a pressing band that presses the material cake against the conveyor device, it is achieved that the material cake is compressed prior to or during the application of liquid, the material cake relaxing downstream of the roll or the pressing band. This causes a "sponge effect" so that liquid on the surface of the material cake is retained by the suction effect and is transported towards the interior of the material cake.

The pressing band may also be part of a second liquid application device that is designed in a manner identical or substantially similar to the first humidifying agent application device. Such a liquid application device can be used in a particularly advantageous manner in the production of chipboards using precompression. In this case, the pressing band is designed as a porous band.

The invention further provides a method for the application of liquid onto a material cake, in which the following steps are carried out:

- applying a liquid to be applied onto a porous section of a conveyor device that transports a material cake,
- applying a first overpressure onto the porous section, wherein the first overpressure transports the liquid through the porous section or retains the liquid on the same.

Here, it may be provided that the porous section is subsequently exposed to a second overpressure, wherein the second overpressure is higher than the first overpressure.

It may be provided that the first and/or the second overpressure are controllable.

In an embodiment of the method of the present invention it is provided that the first overpressure is at most 0.3 bar, preferably at most 0.01 bar, and/or the second overpressure is at most 5 bar.

In the production of material panels, presses are used that strongly compress and heat the material cake. When the material cake enters the press, evaporation occurs due to the high degree of humidity caused by the liquid applied onto the surface, so that a vapor jet occurs through the material cake. This allows for a particularly good heat penetration of the material cake. When the vapor jet is generated, free OH groups can also be formed which may be advantageous in activating a binding agent. Owing to the good heat permeation of the material cake caused by the vapor jet, the setting of the binding agent is accelerated, especially inside the material cake. The humidity on the surface caused by the liquid applied further results in an enhanced surface smoothness of the final pressed panel, whereby the grinding tolerance is reduced for the further processing. Moreover, an enhanced surface smoothness has the effect that the pores at the surface of the panel are smaller, so that a barrier effect is obtained relative to finishes applied later on. The finishes applied later on therefore do not penetrate too deeply into the panel so that the finish consumption is substantially reduced. Therefore, an accurate dosing of the amount of humidifying agent applied onto the material cake is of particular importance in the production of material panels. Due to the liquid application system of the present invention and to the method for the application of liquid onto a material cake, as provided by the invention, an accurate dosing is possible in a particularly advantageous manner. The liquid application system of the present invention and the method of the present invention specifically allow for an advantageous application of the liquid from the lower side of the material cake. Therefore, implementing the liquid application system of the present invention and the method of the present invention in the context of presses for producing material panels is particularly advantageous, since surfaces of particular quality can be produced using the liquid application system of the present invention and the method of the present invention.

In the context of the invention "porous section" refers to a section having pores and thus having small through holes. In a textile or mesh structure, for example, the pores may also be formed by the holes formed between fibers. In the context of the invention, the term "permeable to the liquid to be applied" refers to the fact that the porous section, due to the porosity, is permeable to the liquid to be applied, i.e. that the liquid to be applied can penetrate this section in particular also under the effect of an external influence, such as the first overpressure, for example.

The following is a detailed description of the invention with reference to the accompanying drawings.

Figure 2:
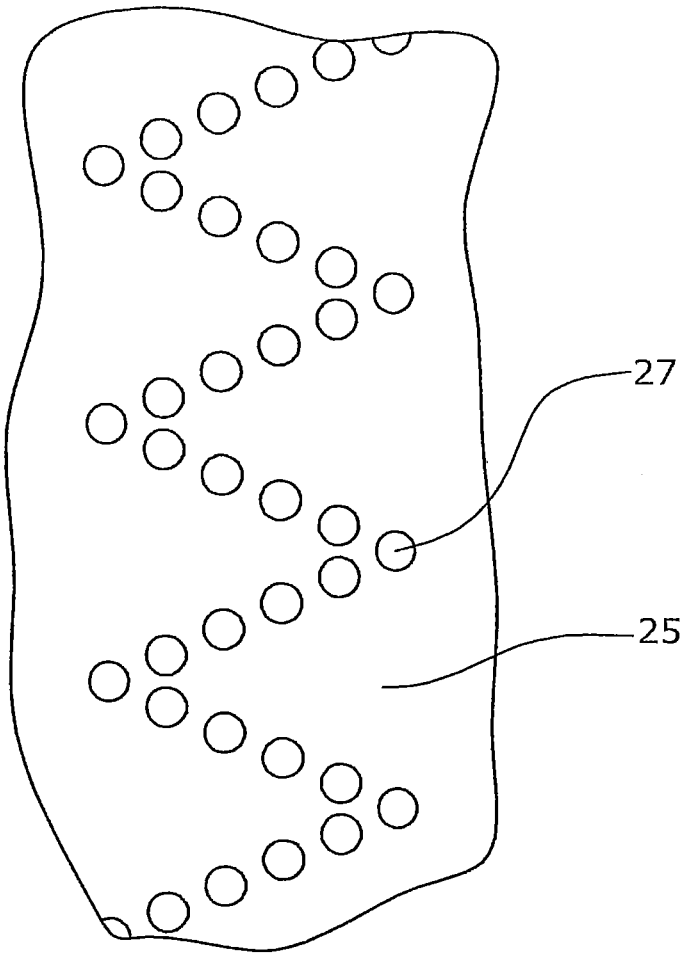

In the Figures:

FIG. 1 is a schematic sectional view of a liquid application system according to the present invention, and FIG. 2 is a detail of the cover of the high-pressure chamber.

FIG. 1 schematically illustrates a section through a liquid application system 1 of the present invention.

In FIG. 1 a liquid application system 1 of the present invention for the application of liquid onto a material cake 100 is schematically shown in sectional view. The liquid application system comprises a conveyor device 3 which in the embodiment illustrated is configured as a porous conveyor belt 5. The material cake 100 lies on the porous conveyor belt 5 and is transported in the direction of transport indicated by an arrow in FIG. 1.

The liquid application system 1 comprises a liquid application device 7 by which a liquid to be applied can be applied in liquid state onto the material cake 100.

The porous conveyor belt 5 of the conveyor device 3 forms a porous section 9 above the liquid application device 7, wherein the porous conveyor belt 5 is permeable to the liquid at least in the porous section 9.

The liquid application device 7 comprises an application device 11 which in the embodiment illustrated is designed as a spraying nozzle. Using the application device 11, the liquid is sprayed in liquid state onto the side of the porous section 9 of the conveyor belt 5 that faces away from the material cake 100.

The liquid application device 7 further comprises an overpressure chamber 13 in which a first overpressure prevails relative to the environment. The overpressure may be 0.003 bar, for example. The overpressure chamber 13 comprises an opening 15 directed towards the porous section 9 of the conveyor belt 5, with the porous section 9 of the conveyor belt 5 sealingly surrounding the opening 15. The overpressure prevailing in the overpressure chamber 13 thus acts against the side of the porous section 9 that faces away from the material cake 100. An airflow is thereby created, so that the liquid sprayed onto this side is transported through the pores of the porous section 9. The overpressure thus overcomes the capillary resistance prevailing in the pores of the porous section 9, the gravity acting on the liquid, as well as the flow resistance, so that the liquid reaches the material cake 100. In this manner, the liquid can be applied onto the material cake 100 in an advantageous manner, in particular on the lower side of the material cake.

In the embodiment illustrated in FIG. 1, the application device 11 is arranged within the overpressure chamber 13. Of course, it is also possible that the same is arranged upstream of the overpressure chamber 13, when seen in the conveying direction, and thus outside the overpressure chamber 13.

The application device 11 may be configured to be pivotable. Further, a cleaning system 17 may be arranged in the overpressure chamber 13, which system is merely indicated in FIG. 1. The cleaning system 17 comprises pivotable cleaning nozzles 19 for ejecting air or a cleaning fluid. During maintenance, the cleaning nozzles 19 can be used to clean the porous section 9 of the conveyor belt 5 from residual material of the material cake and liquid residues. In addition, the cleaning nozzles 19 can be used to clean the overpressure chamber 13 from liquid residues.

The overpressure chamber 13 may further comprise a drain device 21 via which residual liquid or cleaning fluid can be drained during operation or maintenance. If the drain device 21 is used in operation, a counter-pressure must prevail at the same, in order to prevent that the overpressure built in the overpressure chamber 13 is affected by the drain device 21.

Downstream of the first overpressure chamber 13, seen in the conveying direction, the liquid application device 7 further comprises a high-pressure chamber 23 in which a second overpressure prevails relative to the environment. Preferably, the second overpressure in the high-pressure chamber 23 is higher than the first overpressure in the overpressure chamber 13. Preferably, the second overpressure is between 0.2 bar and 5 bar. The porous section 9 of the porous conveyor belt 5 sealingly contacts a cover 25 of the overpressure chamber 23. The cover 25 has a plurality of openings 27 which, as is best seen in FIG. 2 which is a schematic top plan view on the cover 25, are arranged in a pattern. In the embodiment illustrated in FIG. 2, the openings 27 are arranged in a zigzag pattern. The arrangement of the openings 27 as well as the size of the openings 27 is chosen such that the airflow generated by the second overpressure is prevented from causing the material cake 100 to be lifted off the porous section 9 or from causing the conveyor device 5 from being lifted off the cover 25.

The second overpressure prevailing in the high-pressure chamber 23 has the effect that liquid possibly still adhering to or in the porous section 9 of the porous conveyor belt 5 are pressed through the pores of the porous section towards the material cake. In addition, the airflow caused by the second overpressure has the effect that gaps possibly existing between the material cake 100 and the porous section 9 of the conveying belt 5 are overcome, so that the liquid clings to the material cake 100. Further, it is possible due to the second overpressure that liquid in the edge portion of the material cake 100 can be pressed deeper into the material cake, if so desired.

The overpressures prevailing in the overpressure chamber 13 and in the high-pressure chamber 23 can be controlled via control devices not illustrated herein. Thereby, it is possible to adjust the amounts of liquid to be pressed through the porous section 9 and whether the liquid is to be transported farther into the inside of the material cake 100.

A roll, not illustrated herein, or a pressing band, not illustrated herein, may be arranged opposite the liquid application device 7. The material cake 100 is compressed thereby, by making the distance between the porous section 9 and the roll, not illustrated herein, or the pressing band, not illustrated herein, smaller than the normal height of the material cake 100. Downstream of the roll or downstream of the pressing band, seen in the conveying direction, the material cake 100 can relax again, whereby a vacuum is generated inside the material cake and, grace to this "sponge effect", the liquid is advantageously retained on the material cake 100 or transported into the inside of the material cake 100.

The pore width of the porous section 9 may for example be between 0.05 mm and 2 mm. The porous conveyor belt 5 may for example be designed as a textile or be made from a mesh structure. Here, the porous section 9 may have a surface, wherein the percentage of the surface area formed by the material of the conveyor device is between 50% and 95%.

The liquid application system 1 of the present invention is advantageous in that for example a humidifying agent can be applied in liquid state in a particularly advantageous manner onto a material cake 100. This allows for a very accurate dosing of the humidifying agent. The liquid application system 1 may be used in particular in presses for the production of material panels.

The liquid application system 1 may further comprise a second liquid application device which is arranged at the upper side of the material cake 100, the device being of a structure similar or identical to the liquid application device 7. Of course, the liquid application system 1 may also comprise a second liquid application device that applies the liquid onto the material cake 100 in another manner, e.g. via rolls.

The invention claimed is:

1. A liquid application system for the application of liquid to a material cake transported on a conveyor device, the liquid application system comprising a conveyor device comprising a liquid application device, wherein the conveyor device further comprises a porous section on which the material cake lies or which the material cake contacts and which is permeable to a liquid to be applied, the liquid application device comprises an application device via which the liquid to be applied can be applied to the side of the porous section of the conveyor device facing away from the material cake, and the liquid application device comprises an overpressure chamber with a first overpressure relative to the environment by which the porous section of the conveyor device passes, wherein the applied liquid can be transported via the first overpressure through the porous section of the conveyor device or be retained via the first overpressure to the porous section.

2. The liquid application system of claim 1, wherein the application device is arranged in the overpressure chamber.

3. The liquid application system of claim 1, wherein the overpressure chamber comprises an opening directed towards the porous section, the porous section of the conveyor device sealingly surrounding the opening.

4. The liquid application system of claim 1, wherein the liquid application device comprises a high-pressure chamber with a second overpressure relative to the environment, the high-pressure chamber being arranged downstream of the overpressure chamber, seen in the conveying direction of the material cake.

5. The liquid application system of claim 4, wherein the high-pressure chamber comprises a cover with a plurality of openings, the porous section of the conveyor device sealingly contacting the cover.

6. The liquid application system of claim 1, further comprising a cleaning system for cleaning the conveyor device and/or the overpressure chamber.

7. The liquid application system of claim 6, wherein the cleaning system comprises cleaning nozzles for ejecting air or a cleaning fluid.

8. The liquid application system of claim 1, wherein the conveyor device is designed as a porous conveyor belt which forms the porous section.

9. The liquid application system of claim 1, wherein the porous section has a pore width between 0.05 mm and 2 mm.

10. The liquid application system of claim 1, wherein the porous section comprises a surface, wherein the percentage of the surface area formed by the material of the conveyor device is between 50% and 95%.

11. The liquid application system of claim 1, further comprising a roll configured for pressing the material cake against the conveying device, the roll being arranged directly opposite the liquid application device or being situated immediately upstream of the liquid application device, seen in the conveying direction of the material cake.

12. The liquid application system of claim 1, further comprising a pressing band configured for pressing the material cake against the conveying device, wherein the pressing band is arranged directly opposite the liquid application device, is situated immediately upstream of the liquid application device, seen in the conveying direction of the material cake, or spans the liquid application device.

13. A method for the application of liquid onto a material cake, in which comprising the following steps:

applying a liquid onto a porous section of a conveyor device that transports the material cake, applying a first overpressure onto the porous section, wherein the first overpressure transports the liquid through the porous section or retains the liquid on the porous section.

14. The method of claim 13, further comprising the following step:

subsequently applying a second overpressure onto the porous section, the second overpressure being higher than the first overpressure.

15. The method of claim 14 wherein the second overpressure is controllable.

16. The method of claim 14 wherein the second overpressure is 5 bar at most.

17. The method of claim 13, wherein the first overpressure is controllable.

18. The method of claim 17 further comprising the following step:

subsequently applying a second overpressure onto the porous section, the second overpressure being higher than the first overpressure, wherein the second overpressure is controllable. is 5 bar at most.

19. The method of claim 18 wherein the first overpressure is 0.3 bar at most and wherein the second overpressure is 5 bar at most.

20. The method of claim 13, wherein the first overpressure is 0.3 bar at most.

* * * * *